United States Patent [19]

Hines et al.

[11] Patent Number: 4,842,074

[45] Date of Patent: Jun. 27, 1989

[54] GAS STORAGE WELL SAFETY SYSTEM AND METHOD

[75] Inventors: Craig D. Hines, Carrollton; Michael J. Bednarz, Prosper; Ronald K. Churchman, Carrollton, all of Tex.

[73] Assignee: Otis Engineering Corporation, Dallas, Tex.

[21] Appl. No.: 108,790

[22] Filed: Oct. 15, 1987

[51] Int. Cl.[4] ..... E21B 43/12; E21B 34/10

[52] U.S. Cl. ..... 166/305.1; 166/149; 166/184; 166/317; 166/320; 166/321; 166/369; 166/374; 405/53

[58] Field of Search ..... 166/305.1, 320, 321, 166/332, 334, 319, 149, 184, 131, 375, 373, 374, 386, 317, 369; 405/53, 59

[56] References Cited

U.S. PATENT DOCUMENTS

| | | | |
|---|---|---|---|
| Re. 32,343 | 2/1987 | Vinvant et al. | 166/184 X |
| 3,351,133 | 11/1967 | Clark, Jr. et al. | 166/334 X |
| 3,375,874 | 4/1968 | Cherry et al. | 166/321 X |
| 3,459,260 | 8/1969 | Dollison | 166/73 |
| 3,467,184 | 9/1969 | Young | 166/129 |
| 3,481,362 | 12/1969 | Dollison | 137/460 |
| 3,491,831 | 1/1970 | Dollison | 166/72 |
| 3,860,066 | 1/1975 | Pearce et al. | 116/72 |
| 4,039,031 | 8/1977 | Crowe | 166/321 X |
| 4,049,052 | 9/1977 | Arendt | 166/321 X |
| 4,151,880 | 5/1979 | Vann | 166/373 |
| 4,201,363 | 5/1980 | Arendt et al. | 251/62 |
| 4,339,001 | 7/1982 | Paschal | 166/322 |
| 4,354,554 | 10/1982 | Calhoun et al. | 166/321 |
| 4,469,179 | 9/1984 | Crow et al. | 166/319 |
| 4,478,288 | 10/1984 | Bowyer | 166/375 X |
| 4,566,478 | 1/1986 | Deaton | 166/332 X |
| 4,624,310 | 11/1986 | Echols et al. | 166/106 |

FOREIGN PATENT DOCUMENTS

| | | | |
|---|---|---|---|
| 2094861 | 9/1982 | United Kingdom | 166/184 |

*Primary Examiner*—Hoang C. Dang

*Attorney, Agent, or Firm*—Thomas R. Felger

[57] ABSTRACT

A well safety system with two surface controlled subsurface safety valves. The invention allows various alternatives for controlling injection into and production from a gas storage well. For maximum production, gas can flow from the underground storage reservoir to the well surface via a tubing string and the annulus between the tubing and well casing. The invention provides at least two alternative flow paths for injecting kill fluids into the well bore.

5 Claims, 4 Drawing Sheets

GAS STORAGE WELL SAFETY SYSTEM AND METHOD

BACKGROUND OF THE INVENTION

1. Field of the Invention

The present invention discloses a well safety system with two surface controlled subsurface safety valves.

2. Description of Related Art

Gas storage wells are frequently located in depleted hydrocarbon reservoirs at a relatively shallow depth less than five thousand feet. Common characteristics of gas storage wells are relatively low flowing pressures, less than three thousand psi, a large unrestricted flow area and high flow rates with frequent variations in the flow. Examples of subsurface safety valves particularly adapted for use in gas storage wells are shown in U.S. Pat. Nos. 3,481,362; 3,459,260; and 3,491,831. Each of these patents was invented by William W. Dollison and assigned to Otis Engineering Corporation.

Well safety systems with two downhole safety valves have been used from time to time. An example of such a two valve system is shown in U.S. Pat. No. 4,469,179. Normally well safety systems have only one downhole valve, either a direct acting safety valve such as shown in U.S. Pat. No. 4,339,001 or a surface controlled subsurface safety valve such as shown in U.S. Pat. No. 4,201,363.

Subsurface safety valves typically have either a ball, flapper, or poppet type valve closure mechanism as shown in U.S. Pat. No. 3,860,066. However, downhole valves with sliding sleeve type valve closures are known. U.S. Pat. No. 4,624,310 discloses a well safety system with a vent valve that has several characteristics in common with the annulus flow safety valve of the present invention.

The alternative flow paths provided by this invention are similar in some respects to downhole safety systems having "block and kill" valves. An example of such a safety system is shown in U.S. Pat. No. 4,566,478 invented by Thomas M. Deaton.

The above referenced patents are incorporated by reference for all purposes within this application.

SUMMARY OF THE INVENTION

The present invention discloses a downhole safety system which allows for maximum flow from a gas storage well and provides alternative flow paths for gas injection and kill fluid injection. Also, the safety system allows periodic measurement of bottom hole pressure and temperature.

The downhole safety system has two surface controlled subsurface safety valves. The first valve controls fluid communication via a tubing string which extends from the well surface to an underground reservoir or formation. The second valve controls fluid communication between the bore of the tubing string and the annulus defined by the exterior of the tubing and the interior of the casing string.

Additional objects and advantages of the present invention will be readily apparent to those skilled in the art from reading the following written description in conjunction with the drawings and claims.

DESCRIPTION OF THE PREFERRED EMBODIMENT

Figure 1:
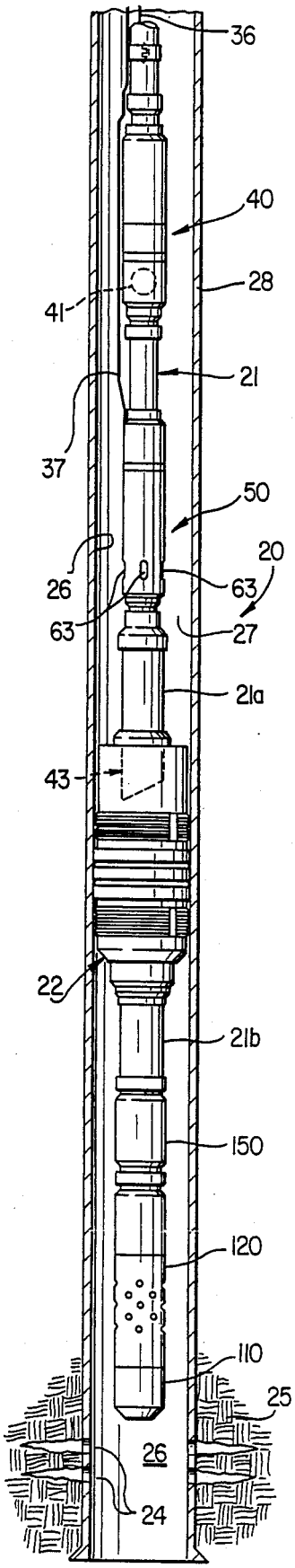
FIG. 1 is a schematic view, partially in section and partially in elevation, showing a subsurface well safety system embodying the present invention.
Figure 2A:
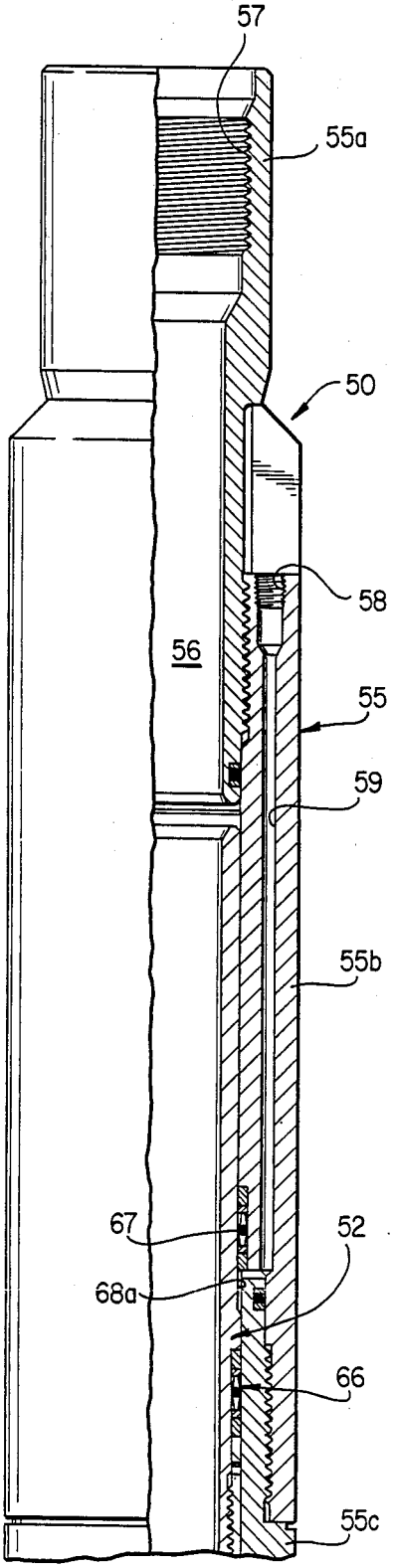
FIGS. 2A, 2B and 2C are drawings, partially in section and partially in elevation, showing an annulus flow safety valve in its first, closed position.
Figure 2B:
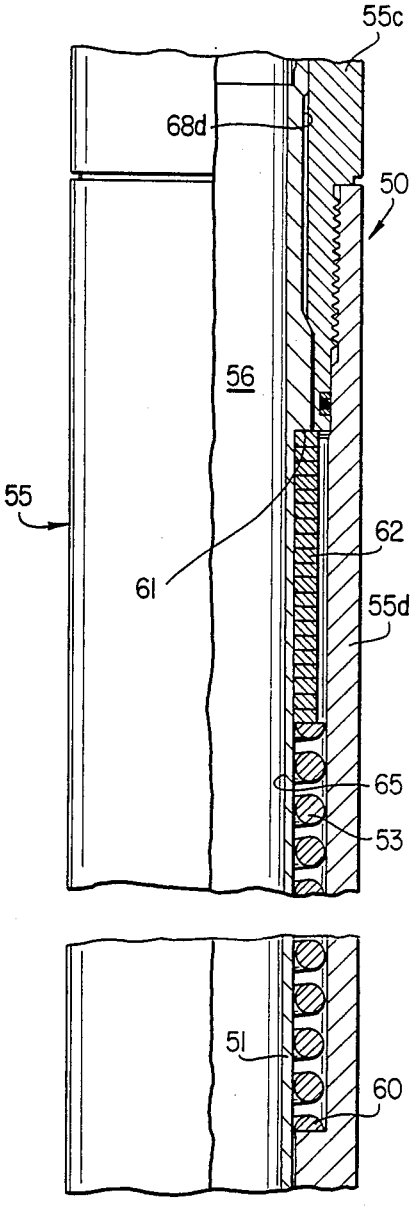
Figure 2C:
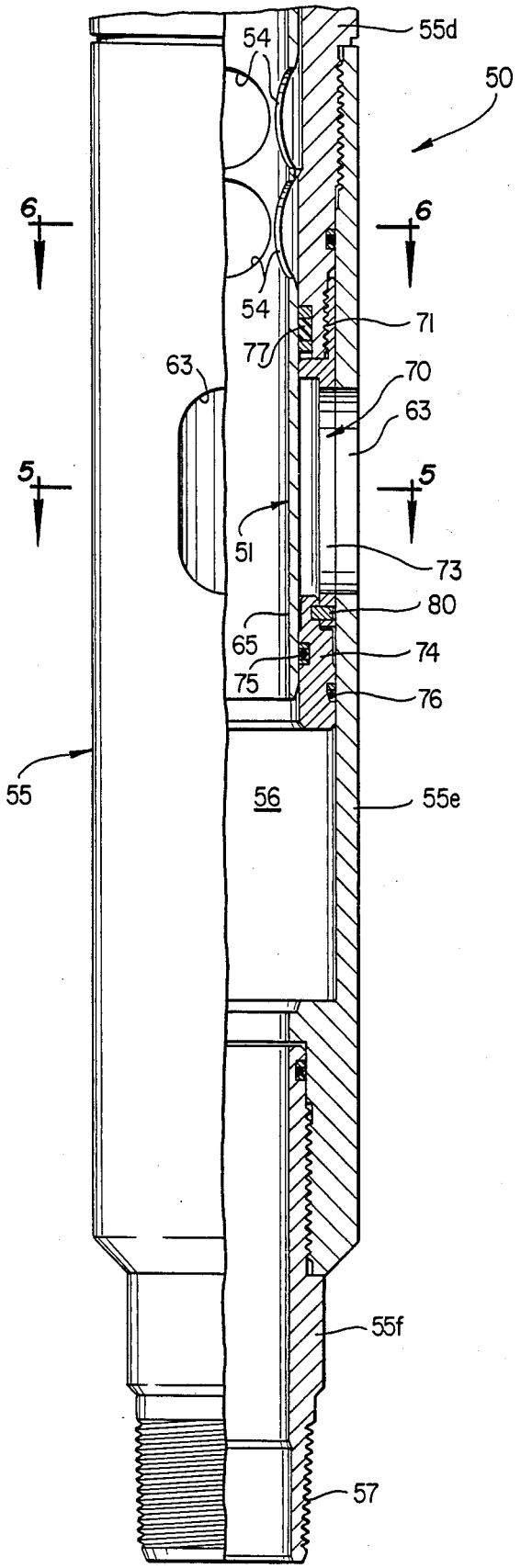
Figure 5:
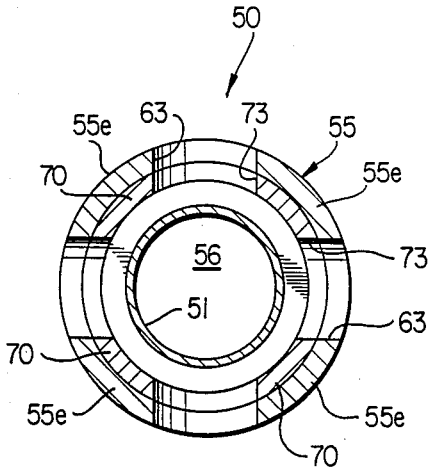
FIG. 5 is a drawing in section along line 5—5 of FIG. 2C.
Figure 6:
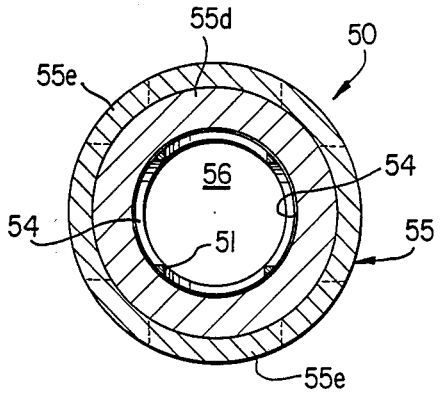
FIG. 6 is a drawing in section along line 6—6 of FIG. 2C.
Figure 7:
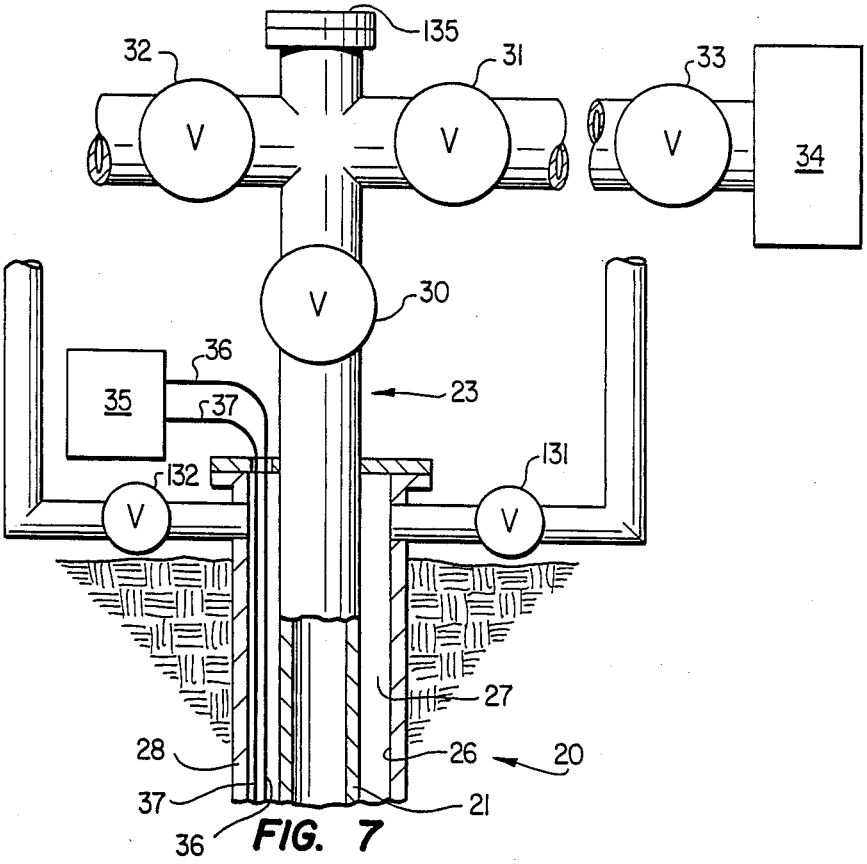
FIG. 7 is a schematic view, partially in section and partially in elevation with portions broken away, showing a typical wellhead associated with the subsurface well safety system of FIG. 1.

Referring to FIGS. 1 and 7, well completion 20 includes casing string 28 extending from wellhead 23 to hydrocarbon producing formation 25. Tubing string 21 is concentrically disposed within casing 28 and extends from wellhead 23 through well packer 22 which seals between tubing string 21 and casing 28. Packer 22 restricts fluid communication through well bore 26 defined in part by the inside diameter of casing 28. Perforations 24 through casing 28 communicate fluids between well bore 26 and formation 25. Packer 22 is located above perforations 24 to direct fluid communication between wellhead 23 and formation 25 through at least a portion of tubing string 21. Flow control valves 30, 31, and 32 at the well surface control fluid communication with tubing string 21. Various well servicing operations may be carried out through wellhead 23 and tubing string 21 such as bottom hole temperature and pressure surveys.

Gas storage wells are designed to allow for both injection of gas into formation 25 via well bore 26 and the withdrawal of gas from formation 25 via the same flow path. Compressor facilities 34 or a similar source provides high pressure gas to wellhead 23 via control valves 33, 31, and 131. The maximum theoretical fluid flow rate through well bore 76 is defined by the inside diameter of casing 28 for a given difference in fluid pressure, fluid density and viscosity. The actual flow rate during gas injection and production depends, among other things, upon the characteristics of formation 25, the number and size of perforations 24, the configuration of wellhead 23 and the size of its associated control valves. To increase the actual flow as much as possible, control valves 31 and 131 are provided to allow injection of gas into both tubing 21 and annulus 27 between tubing 21 and casing 28. Control valves 32 and 132 allow production of gas from both tubing 21 and annulus 27. Therefore, the actual cross-sectional area available for fluid flow through well bore 26 is almost equal to the cross-sectional area defined by the inside diameter of casing 28. The actual flow area available is a function of the wall thickness of tubing string 21 and restrictions created by well packer 22 and safety valves 40 and 50.

Hydraulic control manifold 35 is also located at the well surface to provide hydraulic fluid via control lines 36 and 37 to downhole safety valves 40 and 50. Manifold 35 includes the necessary pumps, valves, and fluid reservoirs required for satisfactory operation of subsurface safety valves.

The downhole safety system shown in FIG. 1 has several major components including well packer 22 which direct fluid communication through tubing 21 and surface controlled subsurface safety valves 40 and 50. Safety valves 40 and 50 are classified as tubing retrievable safety valves (TRSV) because they are an integral portion of tubing string 21. Wireline retrievable safety valves could be used in the downhole safety system, but they generally have a smaller flow area as compared to TRSV. Therefore, TRSV are preferred unless well conditions require a wireline retrievable valve.

Figure 8:
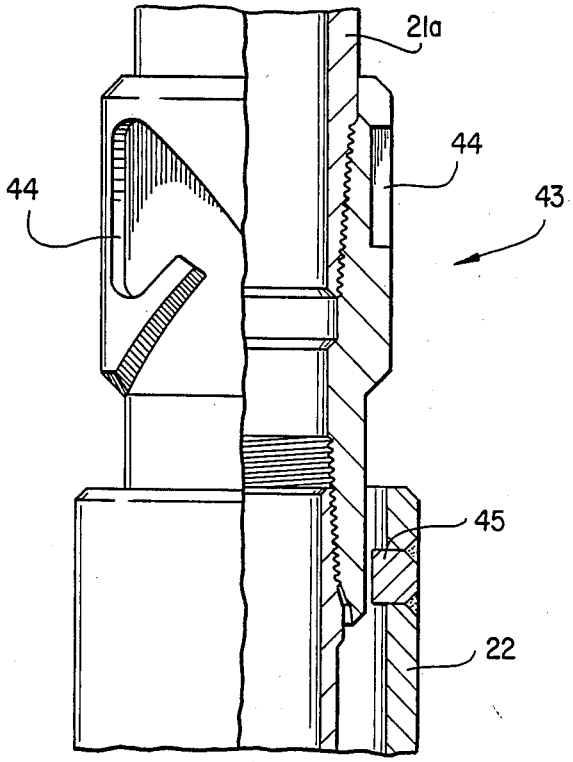
FIG. 8 is a drawing, partially in section and partially in elevation, showing a J-latch and lug to releasably engage a tubing string with a well packer.

Tubing string 21 has two portions or sections —21*a* above well packer 22 and 21*b* below well packer 22. Preferably, upper portion 21*a* is releasably engaged with the top of well packer 22. Safety valves 40 and 50 can be removed (retrieved) from well bore 26 by pulling tubing section 21*a*. Means 43 for releasably engaging upper section 21*a* of tubing 21 with well packer 22 is shown in FIG. 8. Means 43 includes J-latch 44 carried by tubing section 21*a* which can be engaged with lug 45 of packer 22. U.S. Pat. No. 3,467,184 provides detailed information concerning releasable engaging means 43 and a packer suitable for use as well packer 22. However, a wide variety of production well packers and releasable engaging means is commercially available for use with the present invention.

Tubing section 21*b* is attached to well packer 22 and extends downwardly therefrom. Depending upon well conditions, various downhole tools may be included as components of tubing section 21*b*. The components shown in FIG. 1 include landing nipple 150, ported coupling 120 and plug 110. Landing nipple 150 can serve several functions such as providing a location for receiving bottom hole pressure and temperature measuring tools (not shown) or well plug (not shown). Ported coupling 120 acts as a screen with respect to fluid communication between perforations 24 and the bore of tubing 21.

Surface controlled subsurface safety valve 40 is installed in tubing string 21 to control fluid communication between the well surface and formation 25 via tubing string 21. Safety valve 40 preferably has a ball type valve closure means 41. U. S. Pat. No. 4,201,363 shows one ball type safety valve satisfactory for use with the present invention. Subsurface safety valves are generally designed to block fluid pressure only from below the valve. If desired, ball type valve closure means 41 could be designed to block fluid communication both up and down tubing string 21. Other types of valve closures can be used in safety valve 40, but they might limit the alternative methods available for operating well completion 20.

Surface controlled subsurface safety valve 50 is installed in tubing string 21 to control fluid communication between the well surface and formation 25 via annulus 27. Safety valve 50 is thus referred to as an annulus flow safety valve. Safety valve 50 includes sleeve type valve closure means 51 which has a first, closed position and a second, open position. Piston means 52 and spring 53 are used to shift valve closure means 51 between its first and its second position. As shown in U.S. Pat. No. 3,860,066, piston means 52 and spring 53 could be used to open and close either a ball, poppet, or flapper type valve closure means.

The exterior of safety valve 50 is defined by housing means 55 with longitudinal flow passageway 56 extending therethrough. For ease of manufacture and assembly, housing means 55 has six subassemblies 55*a–f*. Each housing means subassembly is generally cylindrical with a longitudinal bore extending therethrough. Each subassembly is threadedly engaged to adjoining subassemblies with appropriate o-ring seals to prevent undesired fluid communication between the interior and exterior of housing means 55. The longitudinal bores of each housing subassembly are concentrically aligned to partially define longitudinal flow passageway 56.

Subassemblies 55*a* and 55*f* at opposite ends of safety valve 50 have female and male threads 57 machined respectively thereon. Threads 57 and subassemblies 55*a* and 55*f* provide means for attaching safety valve 50 to tubing string 21. Housing subassembly 55*b* has threaded opening 58 for engagement with control line 37 and longitudinal bore 59 to communicate control fluid between control line 37 and piston means 52. Housing subassembly 55*c* has a honed inside diameter to cooperate with piston means 52 and provide a slidable fluid barrier. Spring 53 is disposed within the inside diameter of housing subassembly 55*d* between shoulder 60 of housing means 55 and shoulder 61 of valve closure means 51. Spring 53 provides means for biasing valve closure means 51 to its first position. A plurality of spacers 62 may be installed between shoulder 61 and spring 53 to vary the control fluid pressure which opens and closes valve closure means 51. Housing subassembly 55*e* has four oval shaped apertures 63 extending radially therethrough. Apertures 63 and valve closure means 51 cooperate to control fluid communication between the exterior of housing means 55 and longitudinal flow passageway 56. Apertures or radial openings 63 are preferably sized such that their total flow area is greater than the flow area of annulus 27. Longitudinal flow passageway 56 is also sized to have its flow area equal to or greater than the flow area through tubing 21. Safety valve 50 does not restrict fluid communication through tubing string 21.

Figure 3:
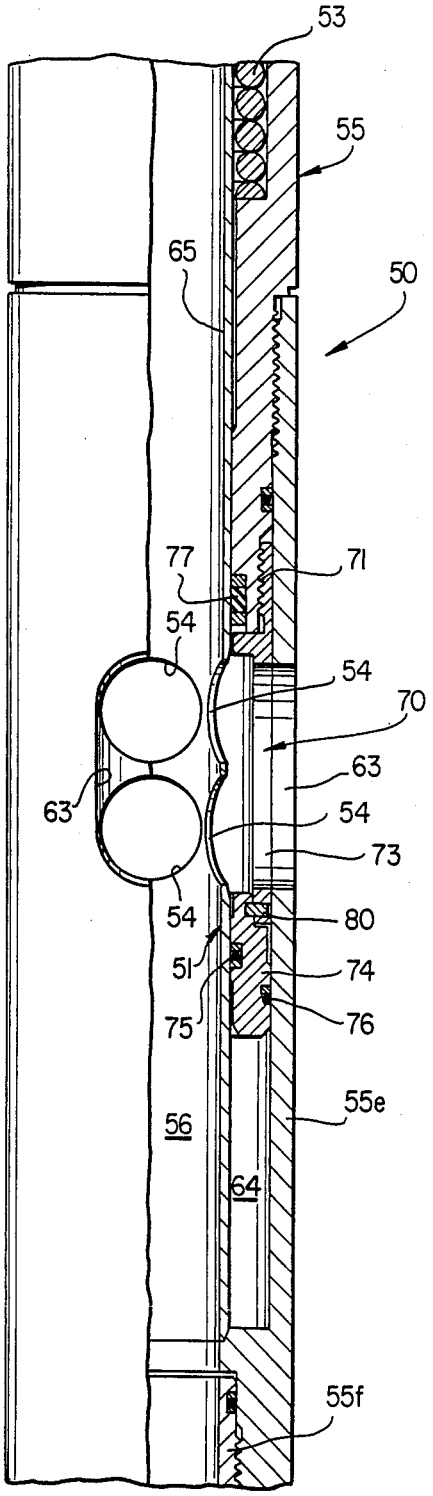
FIG. 3 is a drawing, partially in section and partially in elevation, showing the annulus flow safety valve of FIG. 2C in its second, open position.

Valve closure means 51 is slidably disposed within housing means 55 and forms annulus 64 between its exterior and the interior of housing means 55. Annulus 64 is best shown in FIG. 3. Longitudinal bore 65 extends through valve closure means 51 and partially defines a portion of longitudinal flow passageway 56 through valve 50. Piston means 52 slidably abuts valve closure means 51. Piston means 52 and valve closure means 51 together comprise a long, hollow sleeve within housing means 55. Seal means 66 are carried on the exterior of piston means 52 to establish in cooperation with housing means subassembly 55*c* a first fluid pressure zone 68*a* and second fluid pressure zone 68*b*. Longitudinal bore 59 extends through housing means 55 to communicate control fluid pressure between control line 37 and first pressure zone 68*a*. Seal means 67 is carried on the interior of housing means 55 to form a fluid barrier with the exterior of piston means 52. First and second pressure zones 68*a* and 68*b* are variable volume chamber means partially defined by piston means 52.

Valve seat means 70 is disposed in annulus 64 between valve closure means 51 and housing means subassembly 55*e*. Valve seat means 70 has a generally hollow, cylindrical shape. Threads 71 are used to secure valve seat means 70 within housing means 55. Valve seat means 70 has four oval apertures or radial openings 73 which are sized to be compatible with radial opening 63 in housing means 55. Radial openings 63 and 73 cooperate with longitudinal flow passageway 56 to allow fluid communication between the bore of tubing string 21 and the exterior of safety valve 50.

Valve closure means 51 has four pairs of circular openings 54 extending radially therethrough. When valve closure means 51 is in its first position, circular openings 54 are longitudinally offset from radial openings 63 and 73 blocking fluid communication therethrough. When valve closure means 51 is in its second position, circular openings 54 are radially aligned with oval apertures 63 and 73 to allow fluid communication therethrough. Preferably, the total flow area through circular opening 54 is equal to or greater than the flow area available through annulus 27.

Valve seat means 70 includes slidable seal ring carrier 74. Seal means 75 on the interior of carrier 74 cooperates with the exterior of valve closure means 51 to block undesired fluid flow therepast. Seal means 76 on the exterior of carrier 74 cooperates with the interior of housing means subassembly 55*e* to block undesired fluid flow in a similar manner. Seal means 77 is carried on the interior of housing means 55 to form a fluid barrier with valve closure means 51. Preferably, the effective sealing area of seal means 75 and 77 is equal. Seal means 75 and 77 cooperate to block fluid communication via radial openings 63 and 73 when valve closure means 51 is in its first position.

Figure 4:
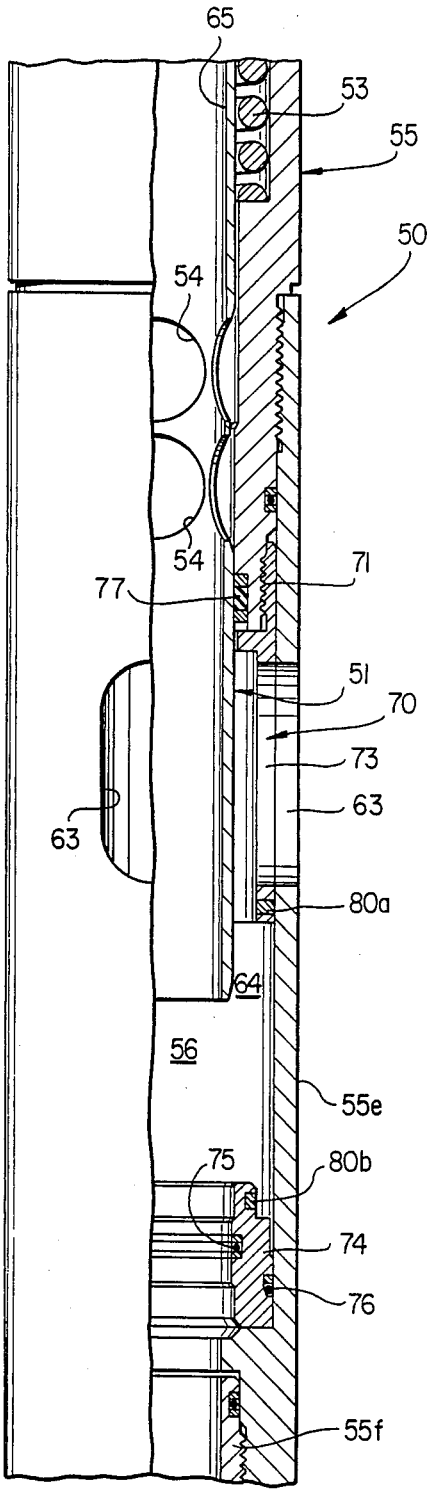
FIG. 4 is a drawing, partially in section and partially in elevation with portions broken away, showing the annulus flow safety valve of FIG. 2C in its third, emergency kill position.

Seal ring carrier 74 is releasably attached to valve seat means 70 by one or more shear pins 80. If sufficient fluid pressure is applied to carrier 74 via openings 63 as compared to the fluid pressure within longitudinal flow passageway 56, pins 80 will shear allowing the fluid pressure to move seal carrier 74 downwardly within annulus 64. As best shown in FIG. 4, releasing carrier 74 from the remainder of valve seat 70 places valve closure means 51 in its third position allowing unrestricted fluid communication via radial openings 63 and 73.

OPERATING SEQUENCE

The following comments are made assuming that safety valves 40 and 50 are installed in a gas producing or storage well completed as shown in FIGS. 1 and 7. Safety valve 40 is opened after first equalizing any difference in pressure across valve closure means 41. One way to equalize pressure differences is to connect tubing 21 to a source of high pressure gas such as compressor 34 via control valves 30, 31, and 33. Control fluid pressure is then directed from control manifold 35 via control line 36 to shift valve 40 from its first, closed position to its second, open position.

A similar sequence is used to open safety valve 50. Any difference in pressure between annulus 27 and longitudinal flow passageway 56 of valve 50 should be equalized prior to shifting valve closure means 51 from its first, closed position to its second, open position. One way to equalize any differences in pressure is to connect annulus 27 to a source of high pressure gas such as compressor 34 via control valve 33 and casing control valve 131. Control fluid pressure is then directed from control manifold 35 via control line 37 to shift valve 50 from its first position to its second position. With both safety valves 40 and 50 in their second position, the maximum volume of gas compatible with well completion 20 can be injected into formation 25 from compressor 34 or withdrawn from formation 25 via control valves 32 and 132.

From time to time, it may be desirable to measure fluid pressure and temperature below well packer 22. Such measurements during gas injection, gas production, and shut-in provide information to evaluate the performance of well completion 20 and reservoir 25. Such measurements can be taken by removing well cap 135 and attaching surface wireline equipment (not shown) thereto. Ball type valve closure means 41 and sleeve type valve closure means 51 are particularly suitable for conducting wireline operations therethrough.

ALTERNATIVE FLOW PATH

The preceding comments described the flow path which maximizes fluid flow rates through well completion 20. Under some well conditions, it may be desirable to store kill fluids in either tubing string 21 above safety valve 40 or annulus 27 above well packer 22. Ball type valve closure means 41 may be designed for holding kill fluids in tubing string 21. Gas can be injected into and produced from formation 25 via tubing section 21*b*, oval apertures 63 in safety valve 50, and annulus 27. When necessary to shut in well 20, control fluid pressure is reduced in first pressure zone 68*a* to below a preselected value which allows spring 53 to shift valve closure means 51 to its first position. After fluid communication through annulus 27 has stopped, control fluid pressure can be directed via control line 36 to open safety valve 40. When valve closure means 41 is in its open position, kill fluid will flow downwardly into well bore 26 below well packer 22 via tubing section 21*b*. One reason to inject kill fluid into well bore 26 would be to create fluid pressure at perforations 24 to block gas flow from formation 25 prior to removing upper tubing section 21*a* from well 20. A plug (not shown) would also probably be installed in landing nipple 150 prior to removing tubing section 21*a*. Kill fluids may also be injected from the well surface through tubing string 21 using the above described flow path. If kill fluids are planned to be injected from the well surface, valve closure means 41 can be either a ball or flapper type.

Kill fluid or corrosion inhibitor fluid can be stored in annulus 27 with safety valve 50 in its first position. In this situation, gas would be injected into and produced from formation 25 only via tubing string 21. Valve closure means 41 would be held in its second, open position by control fluid pressure from control line 36. Valve closure means 51 would be in its first position until kill fluids or corrosion inhibitors were required to be injected into well bore 26 below packer 22.

After closing safety valve 40, fluid stored in annulus 27 can be dumped into well bore 26 via radial openings 63 in safety valve 50. The normal method would be to apply a preselected amount of control fluid pressure to piston means 52 to shift valve closure means 51 to its second, open position. Under emergency conditions, such as failure of control line 37, fluid pressure in annulus 27 can be increased to a preselected value which shears pins 80 and places valve closure means 51 in its third position. See FIG. 4.

The preceding written description explains only some embodiments of the present invention. Those skilled in the art will readily see other modifications and variations without departing from the scope of the invention which is defined by the claims.

We claim:

1. The method of injecting gas into and producing gas from an underground reservoir via a well completed with a casing string, a tubing string concentrically disposed therein, an annulus between the tubing and casing strings, a well packer forming a fluid barrier between the casing and tubing strings, and two surface controlled subsurface safety valves in the tubing string above the well packer comprising:

a. injecting gas from the well surface into the underground reservoir through the tubing string and both safety valves;

b. injecting gas from the well surface into the underground reservoir through the annulus above the well packer, radial openings in one of the safety valves and the tubing below the one safety valve; and c. producing gas from the underground reservoir after injection has been completed via the flow paths defined in step (a) and/or step (b).

2. The method of injecting gas into and producing gas from an underground reservoir as defined in claim 1 further comprising the steps of:

a. closing the other safety valve to prevent fluid communication through the tubing string thereabove;

b. placing kill fluids in the tubing string above the other safety valve; and c. communicating gas between the well surface and the reservoir via the radial openings of the one safety valve.

3. The method of injecting gas into and producing gas from an underground reservoir as defined in claim 1 further comprising during an emergency the steps of:

a. closing the one safety valve to block gas communication via the radial openings; and b. opening the other safety valve to allow kill fluid flow via the tubing string into the casing below the well packer.

4. The method of injecting gas into and producing gas from an underground reservoir as defined in claim 1 further comprising the steps of:

a. closing the one safety valve to block fluid communication through the radial openings;

b. placing kill fluid in the annulus above the well packer; and c. communicating gas between the well surface and the reservoir through the tubing string and both safety valves.

5. The method of injecting gas into and producing gas from an underground reservoir as defined in claim 4 further comprising during an emergency the steps of:

a. closing the other safety valve to block communication through the tubing string thereabove; and b. opening the radial openings in the one safety valve to allow kill fluids to flow via the tubing string into the casing below the packer.

* * * * *